US008277959B2

(12) United States Patent
Arvanitidis

(10) Patent No.: US 8,277,959 B2
(45) Date of Patent: Oct. 2, 2012

(54) CEMENTED CARBIDE BODY AND METHOD

(75) Inventor: Ioannis Arvanitidis, Skogas (SE)

(73) Assignee: Sandvik Intellectual Property AB, Sandviken (SE)

( * ) Notice: Subject to any disclaimer, the term of this patent is extended or adjusted under 35 U.S.C. 154(b) by 238 days.

(21) Appl. No.: 12/616,352

(22) Filed: Nov. 11, 2009

(65) Prior Publication Data

US 2010/0151266 A1 Jun. 17, 2010

(30) Foreign Application Priority Data

Nov. 11, 2008 (EP) ..... 08168848

(51) Int. Cl.
*B32B 9/00* (2006.01)

(52) U.S. Cl. ..... 428/698; 75/240; 75/241; 51/307; 51/309; 428/212; 428/217; 428/325

(58) Field of Classification Search ..... 51/307, 51/309; 428/212, 217, 325, 698; 419/14, 419/15; 75/240, 241
See application file for complete search history.

(56) References Cited

U.S. PATENT DOCUMENTS

| | | | | |
|---|---|---|---|---|
| 4,359,335 A | | 11/1982 | Garner | |
| 4,398,952 A | | 8/1983 | Drake | |
| 4,743,515 A | * | 5/1988 | Fischer et al. | 428/698 |
| 4,820,482 A | | 4/1989 | Fischer et al. | |
| 4,843,039 A | | 6/1989 | Akesson et al. | |
| 4,956,012 A | | 9/1990 | Jacobs et al. | |
| 5,279,901 A | | 1/1994 | Akerman et al. | |
| 5,286,549 A | * | 2/1994 | Hartzell et al. | 428/212 |
| 5,423,899 A | | 6/1995 | Krall et al. | |
| 5,431,239 A | * | 7/1995 | Tibbitts et al. | 51/309 |
| 5,549,980 A | * | 8/1996 | Ostlund et al. | 428/698 |
| 5,623,723 A | | 4/1997 | Greenfield | |
| 5,945,167 A | | 8/1999 | Kuwabara et al. | |

(Continued)

FOREIGN PATENT DOCUMENTS

EP 0 257 869 3/1988

(Continued)

OTHER PUBLICATIONS

European Search Report completed Jun. 2, 2009 issued in European Application No. EP 08 16 8848.

(Continued)

*Primary Examiner* — A. A. Turner
(74) *Attorney, Agent, or Firm* — Morgan, Lewis & Bockius LLP

(57) ABSTRACT

The present invention relates to a method of producing a cemented carbide body comprising providing: (1) a grain refiner compound comprising a grain refiner and carbon and/or nitrogen, and, (2) a grain growth promoter, on at least one portion of the surface of a compact of a WC-based starting material comprising one or more hard-phase components and a binder, and then sintering the compact. The invention also relates to a cemented carbide body comprising a WC-based hard phase and a binder phase, wherein at least one part of an intermediate surface zone has a lower average binder content than a part further into the body, and at least one part of an upper surface zone has in average a larger average WC grain size than the intermediate surface zone. The cemented carbide body can be used as a cutting tool insert for metal machining, an insert for a mining tool, or a coldforming tool.

7 Claims, 7 Drawing Sheets

U.S. PATENT DOCUMENTS

| | | | | |
|---|---|---|---|---|
| 5,989,731 | A * | 11/1999 | Arisawa et al. | 419/15 |
| 7,449,043 | B2 * | 11/2008 | Collin et al. | 75/240 |
| 7,458,646 | B2 * | 12/2008 | Marathe et al. | 299/110 |
| 7,537,726 | B2 * | 5/2009 | Glatzle et al. | 419/14 |
| 7,569,179 | B2 * | 8/2009 | Fang | 419/14 |
| 7,699,904 | B2 * | 4/2010 | Fang | 75/240 |
| 7,887,747 | B2 * | 2/2011 | Iwasaki et al. | 75/241 |
| 2004/0009088 | A1 | 1/2004 | Glatzle et al. | |
| 2005/0126334 | A1 | 6/2005 | Mirchandani | |
| 2005/0276717 | A1 | 12/2005 | Fang | |
| 2007/0214913 | A1 | 9/2007 | Fang | |
| 2007/0227782 | A1 | 10/2007 | Kirk et al. | |

FOREIGN PATENT DOCUMENTS

| | | |
|---|---|---|
| EP | 0 498 781 | 8/1992 |
| EP | 0 500 514 | 8/1992 |
| EP | 0 542 704 | 5/1993 |
| EP | 0 951 576 | 10/1999 |
| EP | 1 364 732 | 11/2003 |
| EP | 1 548 136 | 6/2005 |
| EP | 1 686 193 | 8/2006 |
| EP | 1 739 201 | 1/2007 |
| EP | 1 932 930 | 6/2008 |
| GB | 461872 | 2/1937 |
| JP | 04-128330 | 4/1992 |
| WO | 98/28455 | 7/1998 |
| WO | 2005/056854 | 6/2005 |
| WO | 2009/111749 | 9/2009 |

OTHER PUBLICATIONS

O. Eso, Z. Fang, and A. Griffo; "Liquid phase sintering of Functionally graded WC-CO composites", International Journal of Refractory Metals and Hard Materials 23 (2005) pp. 233-241.

International Search Report for PCT/SE2009/051285, dated May 6, 2010.

Written Opinion of the International Search Report for PCT/SE2009/051285, dated May 6, 2010.

* cited by examiner

CEMENTED CARBIDE BODY AND METHOD

CROSS-REFERENCE TO PRIOR APPLICATION

This application claims priority to European Patent Application No. 08168848 filed Nov. 11, 2008, which is incorporated by reference herein.

BACKGROUND OF THE INVENTION

The present invention relates to a cemented carbide body and to a method of its preparation. The invention also relates to the use of the cemented carbide body in tools.

In cemented carbides, an increase in the binder content typically leads to an increase in toughness but a decrease in hardness and wear resistance. Furthermore, the grain size of the tungsten carbide generally influences the properties in that a finer grain size gives a harder, more wear resistant, material than given by a coarser grain size, but a less impact resistant material.

In applications of cemented carbide materials in cutting and drilling tools, a combination of different properties is desired in order to maximize the efficiency, durability and tool life. There may also be different demands on the material in different parts of a product made from the material. For example, in inserts for rock drilling and mineral cutting a tough material in the interior may be desired in order to minimize the risk of fracture of the insert while a hard material in the surface zone may be desired in order to get sufficient wear resistance.

An insert of cemented carbide for mining tools is generally consumed to up to half of its height or weight during its use. The insert is subjected to impact loads which deformation hardens the binder phase gradually as the insert wears down, thereby increasing the toughness. Generally, in rock drilling and mineral cutting applications, the initial deformation hardening of the binder phase in the surface zone of a cemented carbide insert takes place during the first part, usually the first 1-5% of bit life length. This increases the toughness in the upper surface zone. Before this initial deformation hardening, during the very initial stage of the operation, there is a risk of impact damage to the insert due to a too low toughness. It would be desirable to minimize the risk of this type of early damage by providing a material which is impact resistant at the surface and the part of the material closest to the surface, during at least the initial stage of operation, without trading-off on the general requirements of sufficient internal toughness, surface zone hardness and wear resistance.

Inserts of cemented carbide for use in metal machining operations including severe discontinuous loads such as intermittent operations, or percussive operations, are subjected to high impact loads which increase the risk of damage. Also here, it would be desirable to provide a material which is impact resistant at the surface and the part of the material closest to the surface, without trading-off on said general requirements of internal toughness, hardness and wear resistance.

WO 2005/056854 A1 discloses a cemented carbide insert for drilling rock and cutting mineral. The surface portion of insert has finer grain size and lower binder phase content than the interior portion. The insert is made by placing a powder of a grain refiner containing carbon and/or nitrogen onto the compact prior to sintering.

US 2004/0009088 A1 discloses a green compact of WC and Co which is applied with a grain growth inhibitor and sintered.

EP 1739201 A1 discloses a drill bit including an insert having a binder gradient generated by diffusion of carbon, boron or nitrogen.

JP 04-128330 discloses treatment of a green body of WC and Co with chromium.

OBJECTS AND SUMMARY OF THE INVENTION

It is an object of the present invention to provide a cemented carbide body which is durable and giving long tool life.

It is especially an object of the present invention to provide a cemented carbide body having high resistance against early impact damage.

In one aspect of the invention, there is provided a method of producing a cemented carbide body comprising providing: (1) a grain refiner compound comprising a grain refiner and carbon and/or nitrogen, and, (2) a grain growth promoter, on at least one portion of the surface of a compact of a WC-based starting material comprising one or more hard-phase components and a binder, and then sintering the compact.

In another aspect of the invention, there is provided a method of producing a cemented carbide body comprising first providing a compact and then providing: (1) a grain refiner compound comprising a grain refiner and carbon and/or nitrogen, and, (2) a grain growth promoter being carbon, on at least one portion of the surface of a compact of a WC-based starting material comprising one or more hard-phase components and a binder, and then sintering the compact, wherein the grain refiner compound and/or grain growth promoter is provided by application in the form of a separate or combined liquid dispersion or slurry to the compact.

In still another aspect of the invention, there is provided a cemented carbide body comprising a WC-based hard phase and a binder phase, the body comprising an upper surface zone and an intermediate surface zone, wherein at least one part of the intermediate surface zone has a lower average binder content than a part further into the body, at least one part of the upper surface zone has in average a larger average WC grain size than the intermediate surface zone.

DETAILED DESCRIPTION OF THE PREFERRED EMBODIMENTS

Figure 1:
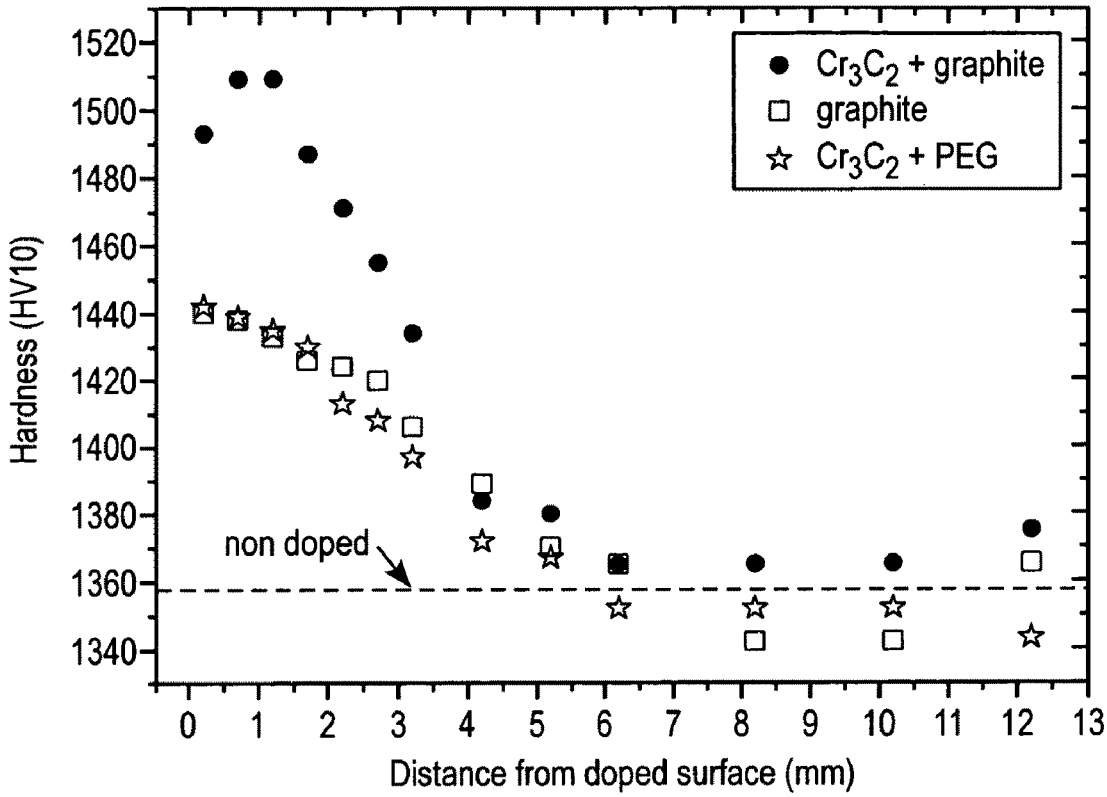
FIG. 1 shows the hardnesses (HV10) measured at different distances below the surface.

The present invention provides a method of producing a cemented carbide body comprising providing: (1) a grain refiner compound comprising a grain refiner and carbon and/or nitrogen, and, (2) a grain growth promoter, on at least one portion of the surface of a compact of a WC-based starting material comprising one or more hard-phase forming components and a binder, and then sintering the compact.

The WC-based starting material has suitably a binder content of from about 4 to about 30 wt %, preferably from about 5 to about 15 wt %. The content of the one or more hard-phase forming components in the WC-based starting material is suitably from about 70 to about 96 wt %, preferably from about 90 to about 95 wt %. Suitably, WC comprises more than 70 wt % of the hard-phase forming components, preferably more than 80 wt %, more preferably more than 90 wt %. Most preferably the hard-phase forming components consist essentially of WC. Examples of hard-phase forming components apart from WC are other carbides, nitrides or carbonitrides, of which examples are TiC, TaC, NbC, TiN and TiCN. Apart from the hard-phase forming components and binder, incidental impurities may be present in the WC-based starting material.

The binder is suitably one or more of Co, Ni, and Fe, preferably Co and/or Ni, most preferably Co.

The compact is suitably provided by pressing a WC-based starting material in the form of a powder.

The cemented carbide body is suitably a cemented carbide tool, preferably a cemented carbide tool insert. In one embodiment the cemented carbide body is a cutting tool insert for metal machining. In one embodiment the cemented carbide body is an insert for a mining tool, such as a rock drilling tool or a mineral cutting tool, or for an oil and gas drilling tool. In one embodiment the cemented carbide body is a coldforming tool, such as a tool for forming thread, beverage cans, bolts and nails.

The grain refiner is suitably chromium, vanadium, tantalum or niobium, preferably chromium or vanadium, most preferably chromium.

The grain refiner compound is suitably a carbide, mixed carbide, carbonitride or a nitride. The grain refiner compound is suitably selected from the group of carbides, mixed carbides, carbonitrides or nitrides of vanadium, chromium, tantalum and niobium. Preferably, the grain refiner compound is a carbide or nitride of chromium or vanadium, such as $Cr_3C_2$, $Cr_{23}C_6$, $Cr_7C_3$, $Cr_2N$, CrN or VC, most preferably carbides of chromium, such as $Cr_3C_2$, $Cr_{23}C_6$, or $Cr_7C_3$.

The grain growth promoter is preferably promoting migration of binder into the cemented carbide body. The grain growth promoter is suitably carbon. The carbon provided onto the surface of the compact may be in the form of deposited carbon from a carburizing atmosphere, amorphous carbon, which is present in, e.g., soot and carbon black, or graphite. Preferably, the carbon is in the form of soot or graphite.

The weight ratio of grain refiner compound, to grain growth promoter, is suitably from about 0.05 to about 50, preferably from about 0.1 to about 25, more preferably from about 0.2 to about 15, even more preferably from about 0.3 to about 12, most preferably from about 0.5 to about 8.

The grain refiner compound is suitably provided onto the surface or surfaces in an amount of from about 0.1 to about 100 mg/cm$^2$, preferably in an amount of from about 1 to about 50 mg/cm$^2$. The grain growth promoter is suitably provided onto the surface or surfaces in an amount of from about 0.1 to about 100 mg/cm$^2$, preferably in an amount of from about 0.5 to about 50 mg/cm$^2$.

One portion or several separate portions of the compact may be provided with the grain refiner compound and grain growth promoter.

In one embodiment the method comprises providing the grain refiner compound and grain growth promoter on the surface of the compact by first providing a compact and then providing the grain refiner compound and the grain growth promoter on at least one portion of the surface of the compact. The grain refiner compound and/or grain growth promoter may be provided by application in the form of a separate or combined liquid dispersion or slurry to the compact. In such a case, the liquid phase is suitably water, an alcohol or a polymer such as polyethylene glycol. The grain refiner compound and grain growth promoter may alternatively be provided by application in the form of solid substances to the compact, preferably powder. The application of the grain refiner compound and grain growth promoter onto the compact is suitably made by applying the grain refiner compound and grain growth promoter onto the compact by, dipping, spraying, painting, or application onto the compact in any other way. When the grain growth promoter is carbon, it may alternatively be provided onto the compact from a carburizing atmosphere. The carburizing atmosphere suitably comprises one or more of carbon monoxide or a $C_1$-$C_4$ alkane, i.e., methane, ethane, propane or butane. The carburizing is suitably conducted at a temperature of from about 1200 to about 1550° C.

In one embodiment the method comprises providing the grain refiner compound and grain growth promoter on the surface of a compact by combining the grain refiner compound and the grain growth promoter with a WC-based starting material powder which is then pressed into a compact. The provision of the grain refiner compound and grain growth promoter on the surface of the compact is suitably made by introducing the grain refiner compound and the grain growth promoter into a pressing mould prior to the introduction of a WC-based starting material powder followed by pressing. The grain refiner compound and grain growth promoter is suitably introduced into the pressing mould as a dispersion or slurry. In such a case, the liquid phase in which the grain refiner compound is dispersed or dissolved is suitably water, an alcohol or a polymer such as polyethylene glycol. Alternatively, one or both of the grain refiner compound and grain growth promoter is introduced into the pressing mould as a solid substance.

The envelope surface area of the compact provided with the grain refiner and grain growth promoter is suitably from about 1 to about 100% of the total envelope surface area of the compact, preferably from about 5 to about 100%.

In the case of producing an insert for mining tools, such as an insert for a drill bit, the portion of the compact applied with the grain refiner and grain growth promoter is suitably located at a tip portion. The envelope surface area applied with the grain refiner and grain growth promoter is suitably from about 1 to about 100% of the total envelope surface area of the compact, preferably from about 5 to about 80%, more preferably from about 10 to about 60%, most preferably from about 15 to about 40%.

Gradients of grain refiner content and binder content are suitably formed inwards from the surface of the compact during sintering.

During sintering the grain refiner is diffused away from the surface or surfaces provided with the grain refiner compound, thereby suitably forming a zone with an in average decreasing content of grain refiner when going deeper into the body.

A zone is also suitably formed during sintering with an in average increasing content of binder when going deeper into the body.

The sintering temperature is suitably from about 1000° C. to about 1700° C., preferably from about 1200° C. to about 1600° C., most preferably from about 1300° C. to about 1550° C. The sintering time is suitably from about 15 minutes to about 5 hours, preferably from about 30 minutes to about 2 hours.

The present invention further relates to a cemented carbide body obtainable by the method according to the invention.

The present invention further provides a cemented carbide body comprising a WC-based hard phase and a binder phase, the body comprising an upper surface zone and an intermediate surface zone, wherein at least one part of the intermediate surface zone has a lower average binder content than a part further into the body, at least one part of the upper surface zone has in average a larger average WC grain size than the intermediate surface zone.

The upper surface zone suitably comprises the distance from a surface point down to a depth d1. The intermediate surface zone suitably comprises the distance from d1 down to a depth d2. The ratio d1 to d2 is suitably from about 0.01 to about 0.8, preferably from about 0.03 to about 0.7, most preferably from about 0.05 to about 0.6.

A bulk zone is optionally present beneath the depth d2. In the bulk zone the cemented carbide is suitably essentially homogeneous with no significant gradients or variations of binder content or hardness present.

The depth d1 is suitably from about 0.1 to 4 mm, preferably from about 0.2 to 3.5 mm. The depth d2 is suitably from about 4 to about 15 mm, preferably from about 5 to about 12 mm, or to the most distant part from the surface point, whichever is reached first.

In one embodiment, the at least one part of the upper surface zone has in average a larger average WC grain size than the bulk zone.

The cemented carbide body has suitably a total average binder content of from about 4 to about 30 wt %, preferably from about 5 to about 15 wt %. The total average content of WC-based hard phase in the cemented carbide body is suitably from about 70 to about 96 wt %, preferably from about 85 to about 95 wt %. The WC-based hard phase suitably comprises more than about 70 wt % WC, preferably more than 80 wt %, more preferably more than 90 wt %. Most preferably the WC-based hard phase consists essentially of WC. Examples of components in the hard-phase apart from WC are other carbides, nitrides or carbonitrides, of which examples are TiC, TaC, NbC, TiN and TiCN. Apart from the WC-based hard phase and binder, incidental impurities may be present in the cemented carbide body.

The binder is suitably one or more of Co, Ni, and Fe, preferably Co and/or Ni.

The cemented carbide body suitably comprises a gradient of content of the grain refiner. The grain refiner is suitably chromium or vanadium, preferably chromium. The content of grain refiner suitably decreases in average when going from the surface point inwards through the intermediate surface zone in the cemented carbide body. If a bulk zone is present, the content of grain refiner suitably decreases in average when going from the surface point inwards to the bulk zone, in the cemented carbide body.

The content of grain refiner in the upper surface zone is suitably from about 0.01 to about 5 wt %, preferably from about 0.05 to about 3 wt %, most preferably from about 0.1 to about 1 wt %.

The cemented carbide body suitably comprises a gradient of content of the binder. The content of binder suitably increases in average when going through the intermediate surface zone in the cemented carbide body. If a bulk zone is present, the gradient comprises the content of binder suitably increases in average when going through the intermediate surface zone to the bulk zone. The weight ratio binder concentration in the bulk zone to binder concentration at a depth of 1 mm from a surface point is suitably from about 1.05 to about 5, preferably from about 1.1 to about 3.5, most preferably from about 1.3 to about 2.5. If no bulk zone is present, the weight ratio binder concentration at the most distant part from the surface point to binder concentration at a depth of 1 mm from the surface point is suitably from about 1.05 to about 5, preferably from about 1.1 to about 4, most preferably from about 1.2 to about 3.5.

The average WC grain size, as mean equivalent circle diameter, is suitably from about 0.5 to about 10 μm, preferably from about 0.75 to about 7.5 μm.

The hardness (HV10) in different parts of the cemented carbide body is suitably within the range of from about 1000 to about 1800.

The cemented carbide body suitably comprises at least one maximum of its hardness situated below the surface.

The hardness maximum is suitably situated at a depth from the surface of from about 0.1 to about 4 mm, preferably at a depth of from about 0.2 to about 3.5. In one embodiment more than one maximum of hardness is present in the body at this depth.

If the hardness (HV10) maximum is ≧1300 HV10, then the hardness maximum is suitably situated at a depth from the surface of from about 0.2 to about 3 mm, preferably at a depth of from about 0.3 to about 2 mm.

If the hardness (HV10) maximum is <1300 HV10, then the hardness maximum is suitably situated at a depth from the surface of from about 0.5 to about 4 mm, preferably at a depth of from about 0.7 to about 3.5 mm.

The ratio of a hardness (HV10) maximum in the body to the hardness (HV10) of the cemented carbide body at a surface point closest to the hardness maximum, is suitably from about 1.001 to about 1.075, preferably from about 1.004 to about 1.070, more preferably from about 1.006 to about 1.065, even more preferably from about 1.008 to about 1.060, even more preferably from about 1.010 to about 1.055, most preferably from about 1.012 to about 1.050. For practical reasons, the surface point hardness is suitably taken as the value measured at a depth of 0.2 mm, except if the hardness maximum is present at a depth of ≦0.2 mm where suitably any value measured at a depth of <0.1 mm can be taken.

The difference of a hardness (HV10) maximum of the cemented carbide body and the hardness (HV10) in the bulk zone, is suitably at least about 50 HV10, preferably at least 70 HV10.

If the average grain size in the cemented carbide body is <4 μm, measured with the equivalent circle diameter method, then the difference of a hardness (HV10) maximum of the cemented carbide body and the hardness (HV10) in the bulk zone, is suitably at least about 100 HV10, preferably at least 130 HV10.

Suitably, at least one surface point closest to a hardness maximum in the cemented carbide body is located at the tip portion of a mining tool insert.

On at least one part of the cemented carbide body the ratio of the grain size, at a depth of 0.3 mm, to the grain size, at a depth of 5 mm, or in the bulk zone, is suitably from about 1.01 to about 1.5, preferably from about 1.02 to about 1.4, more preferably from about 1.03 to about 1.3, most preferably from about 1.04 to about 1.25. The grain size is measured as mean equivalent circle diameter.

On at least one part of the cemented carbide body the ratio of the grain size, at a depth of 0.3 mm, to the grain size, at a depth of 3 mm, is suitably from about 1.01 to about 1.5, preferably from about 1.02 to about 1.3, more preferably from about 1.03 to about 1.2, most preferably from about 1.04 to about 1.15. The grain size is measured as mean equivalent circle diameter.

The cemented carbide body can be coated with one or more layers according to known procedures in the art. For example, layers of TiN, TiCN, TiC, and/or oxides of aluminum may be provided onto the cemented carbide body.

The cemented carbide body is suitably a cemented carbide tool, preferably a cemented carbide tool insert. In one embodiment the cemented carbide body is a cutting tool insert for metal machining. In one embodiment the cemented carbide body is an insert for a mining tool, such as a rock drilling tool or a mineral cutting tool, or for an oil and gas drilling tool. In one embodiment the cemented carbide body is a coldforming tool, such as a tool for forming thread, beverage cans, bolts and nails.

For a mining tool insert, the geometry of the insert is typically ballistic, spherical or conical shaped, but also chisel shaped and other geometries are suitable in the present invention. The insert suitably has a cylindrical base portion with a diameter D, and length L, and a tip portion. L/D is suitably from about 0.5 to about 4, preferably from about 1 to about 3.

The present invention further relates to the use of the cemented carbide tool insert in rock drilling or mineral cutting operations.

The invention is additionally illustrated in connection with the following examples, which are to be considered as illustrative of the present invention. It should be understood, however, that the invention is not limited to the specific details of the examples.

EXAMPLE 1

A cemented carbide powder blend was made by using standard raw materials having a composition of 94 wt-% WC and 6 wt % Co.

Compacts were made in the form of inserts for mining tools in the form of drill bits of 16 mm length having a cylindrical base of 10 mm diameter and a spherical (half dome) tip.

The average grain size was about 1.25 measured as mean equivalent circle diameter.

The tips were applied, "doped", with $Cr_3C_2$ as grain refiner compound, graphite as grain growth promoter or a combination thereof, according to Table 1. As a further reference one insert was not applied with anything, i.e., non-doped.

TABLE 1

| Sample | |
|---|---|
| 1 | $Cr_3C_2$-doped |
| 2 | graphite-doped |
| 3 (the invention) | $Cr_3C_2$-graphite-doped |
| 4 | (non-doped) |

The grain refiner compound $Cr_3C_2$ was applied alone by dipping a tip in a dispersion of 25 wt % $Cr_3C_2$ in polyethylene glycol. The grain growth promoter graphite was applied alone by dipping a tip in a slurry of 10 wt % graphite in water followed by drying. A combination of $Cr_3C_2$ and graphite was applied by a combined dispersion comprising 25 wt % $Cr_3C_2$ and 7.5 wt % graphite in water. For all samples about 20 mg of slurry or dispersion was applied onto about 1.6 $cm^2$ of the tip.

The inserts were dried and then sintered at 1410° C. for 1 hour by conventional gas pressure sintering.

Vickers hardness was measured for the inserts on different depths, i.e., distances from the surface.

FIG. 1 shows the hardnesses (HV10) measured at different distances below the surface. It is evident that using graphite with $Cr_3C_2$ generates outstanding hardness gradients. Doping with graphite solution increases the surface hardness around 80 in HV as compared with non-doped samples. Samples doped with $Cr_3C_2$ in liquid PEG have about the same hardness increase around 80 HV higher than non-doped samples. Samples with $Cr_3C_2$ in graphite solution get a hardness increase of more than 150 HV. It is seen that hardness drops down just below the surface.

Figure 2:
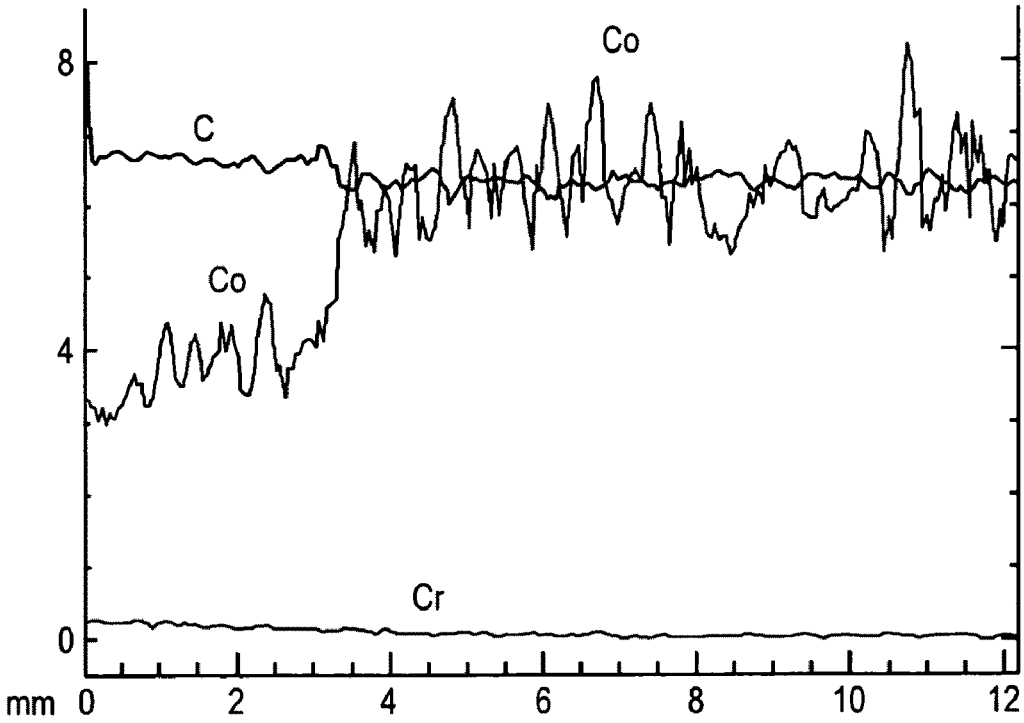
FIG. 2 shows the contents of cobalt, carbon and chromium in a sample of the invention at different distances below the surface.
Figure 3:
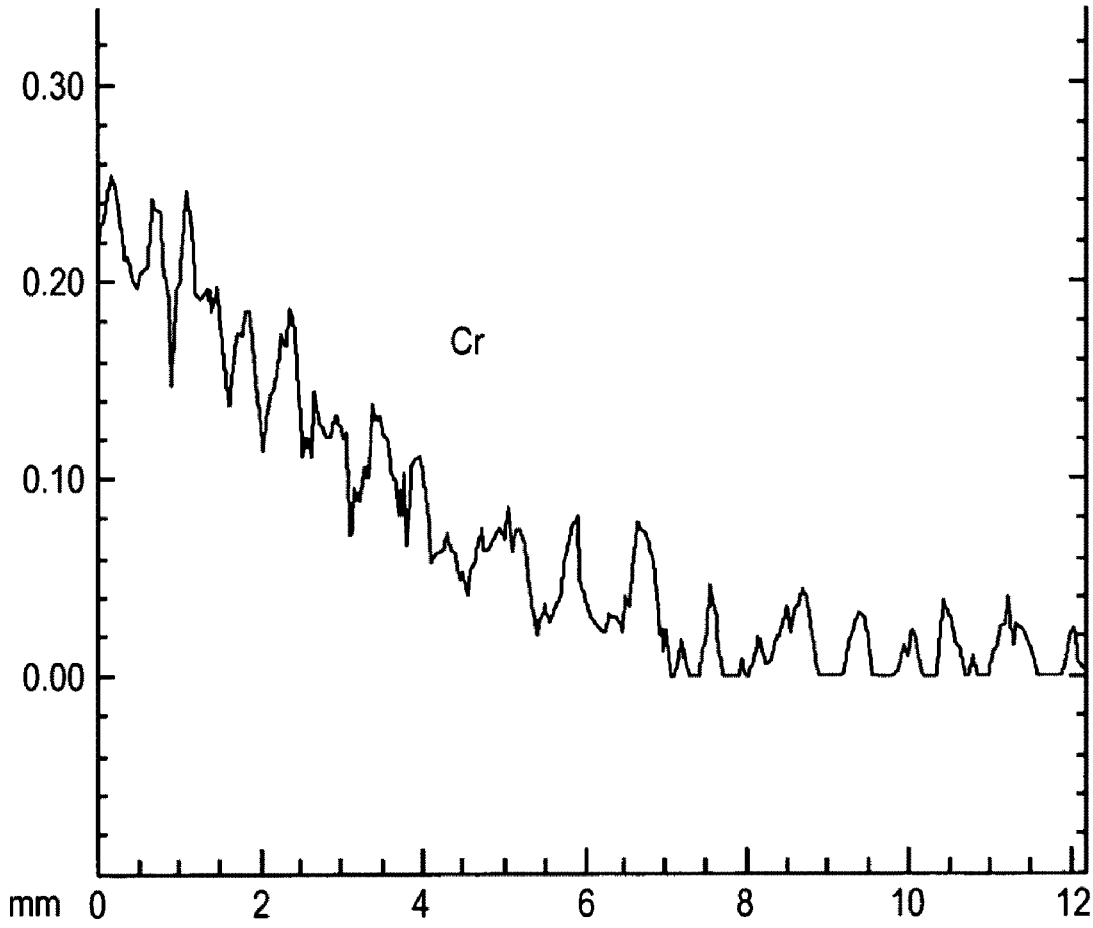
FIG. 3 further shows a detailed view of the gradient of chromium.

FIG. 2 shows the contents of cobalt, carbon and chromium in Sample 3 at different distances below the surface. FIG. 3 further shows a detailed view of the gradient of chromium. Clear gradients of cobalt and chromium are present.

The grain sizes were calculated from electron backscatter diffraction (EBSD) images.

Figure 4:
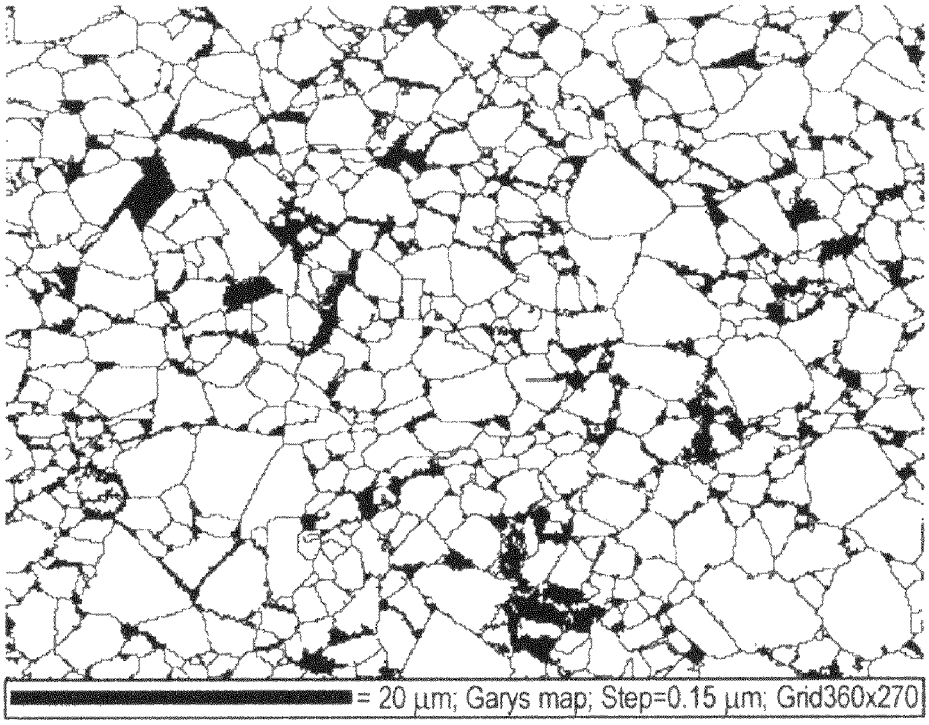
FIGS. 4-5 show representative EBSD images of a sample of the invention at 0.3 and 10 mm depths respectively.
Figure 5:
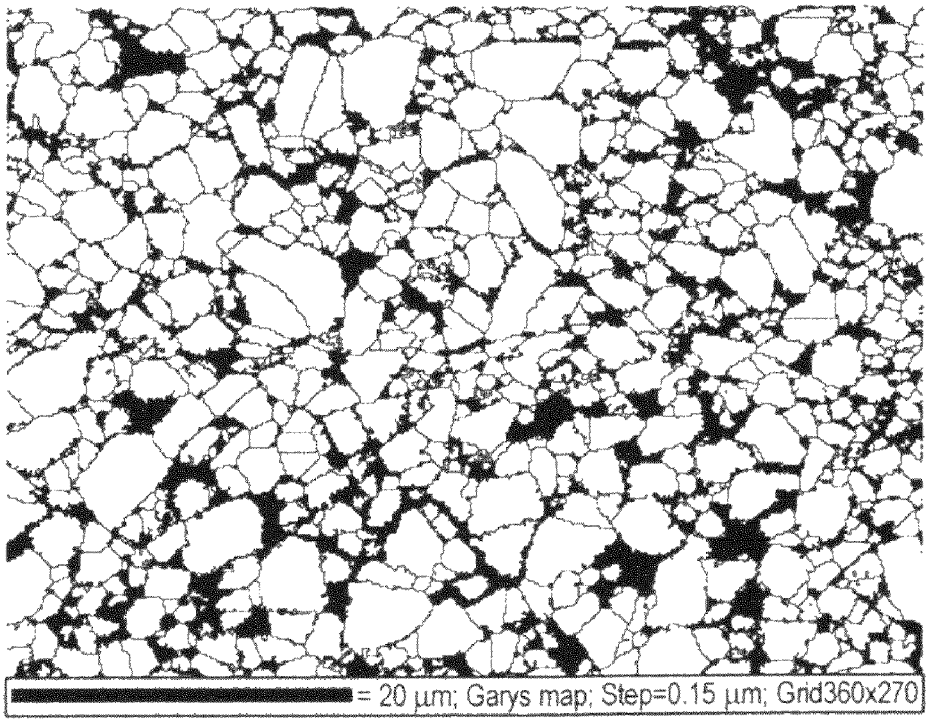

FIGS. 4 and 5 show representative EBSD images of Sample 3 (the invention) at 0.3 and 10 mm depths respectively.

Table 2 shows a comparison of the grain size (equivalent circle diameter) between Sample 1 ($Cr_3C_2$-doped) and Sample 3 ($Cr_3C_2$-graphite-doped).

TABLE 2

| Distance beneath the surface (mm) | Mean equivalent circle diameter, (μm) Sample 1 Cr3C2-doped | Sample 3 Cr3C2-graphite-doped |
|---|---|---|
| 0.3 (= upper surface zone) | 1.24 | 1.55 |
| 10 (= bulk zone) | 1.29 | 1.26 |

The largest grains are found closest to the surface. A maximum in hardness is found around 1 mm beneath the surface.

EXAMPLE 2

Compacts of the same size and composition as in Example 1 were applied, "doped", with $Cr_2N$ or CrN as grain refiner compounds and/or graphite as grain growth promoter according to Table 3.

TABLE 3

| Sample | |
|---|---|
| 5 | graphite-doped |
| 6 (the invention) | $Cr_2N$-graphite-doped |
| 7 (the invention) | CrN-graphite-doped |

The grain growth promoter graphite was applied alone by dipping a tip in a slurry of 10 wt % graphite in water followed by drying. A combination of $Cr_2N$, or CrN, and graphite was applied by a combined dispersion comprising 20 wt % $Cr_2N$ and 8 wt % graphite, or 22 wt % CrN and 8.8 wt % graphite, respectively, in water. For all samples about 20 mg of slurry or dispersion was applied onto about 1.6 $cm^2$ of the tip.

The inserts were dried and then sintered at 1410° C. for 1 hour by conventional gas pressure sintering.

Vickers hardness was measured for the inserts on different depths, i.e., distances from the surface.

Figure 6:
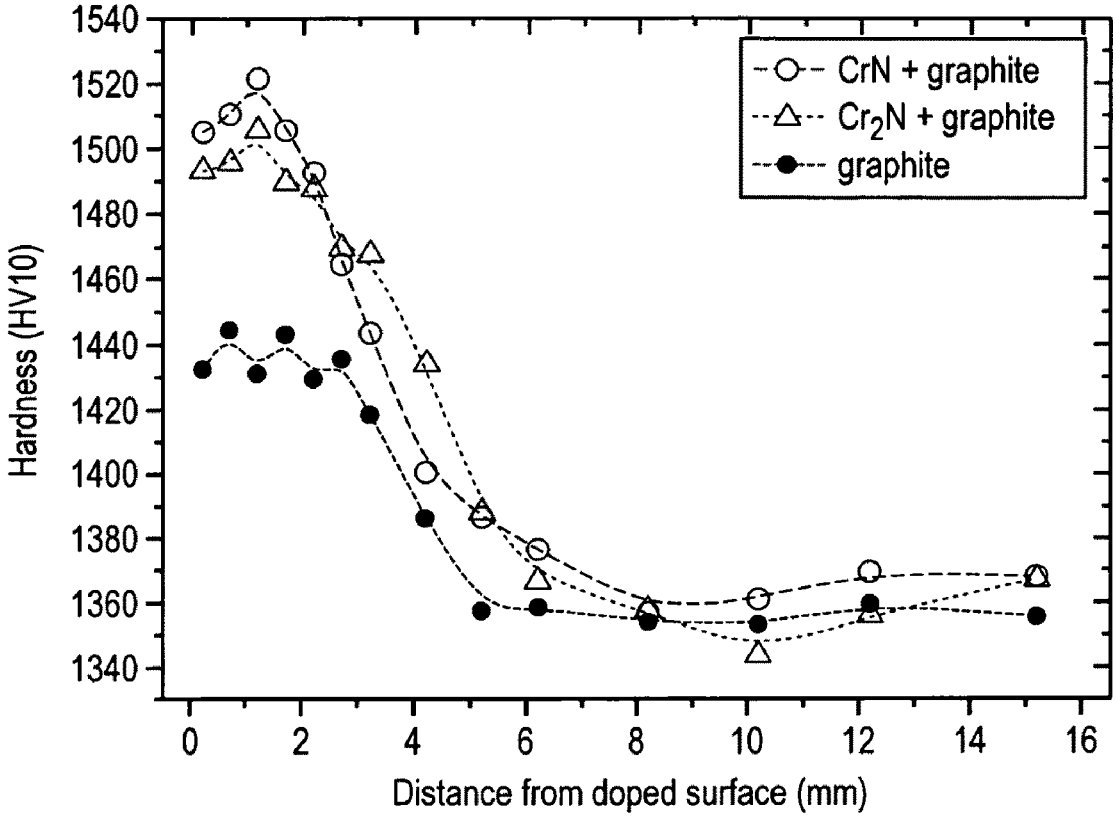
FIG. 6 shows the hardnesses (HV10) for three samples of the invention measured below the surface.

FIG. 6 shows the hardnesses (HV10) (for Samples 5, 6 and 7) measured below the doped surface. It is evident that using graphite with $Cr_2N$ or CrN generates outstanding hardness gradients.

Table 4 shows the hardnesses for Sample 6 ($Cr_2N$-graphite-doped) and Sample 7 (CrN-graphite-doped) at different distances from the surface.

TABLE 4

| Distance | Hardness (HV10) | | |
|---|---|---|---|
| beneath the surface (mm) | Sample 5 (graphite-doped) | Sample 6 (Cr2N-graphite-doped) | Sample 7 (CrN-graphite-doped) |
| 0.2 | 1432 | 1493 | 1505 |
| 0.7 | 1446 | 1496 | 1510 |
| 1.2 | 1431 | 1506 | 1522 |
| 1.7 | 1443 | 1490 | 1506 |
| 2.7 | 1436 | 1470 | 1464 |
| 5.2 | 1358 | 1388 | 1386 |
| 8.2 | 1354 | 1358 | 1357 |

There is an increase in hardness of about 140-160 units (HV) as compared with unaffected bulk material (8.2 mm depth) for the samples according to the invention. The sample which has been only graphite-doped shows an increase in hardness of only about 90 units (HV). A maximum in hardness is found around 1.2 mm beneath the surface for the samples according to the invention.

Figure 7:
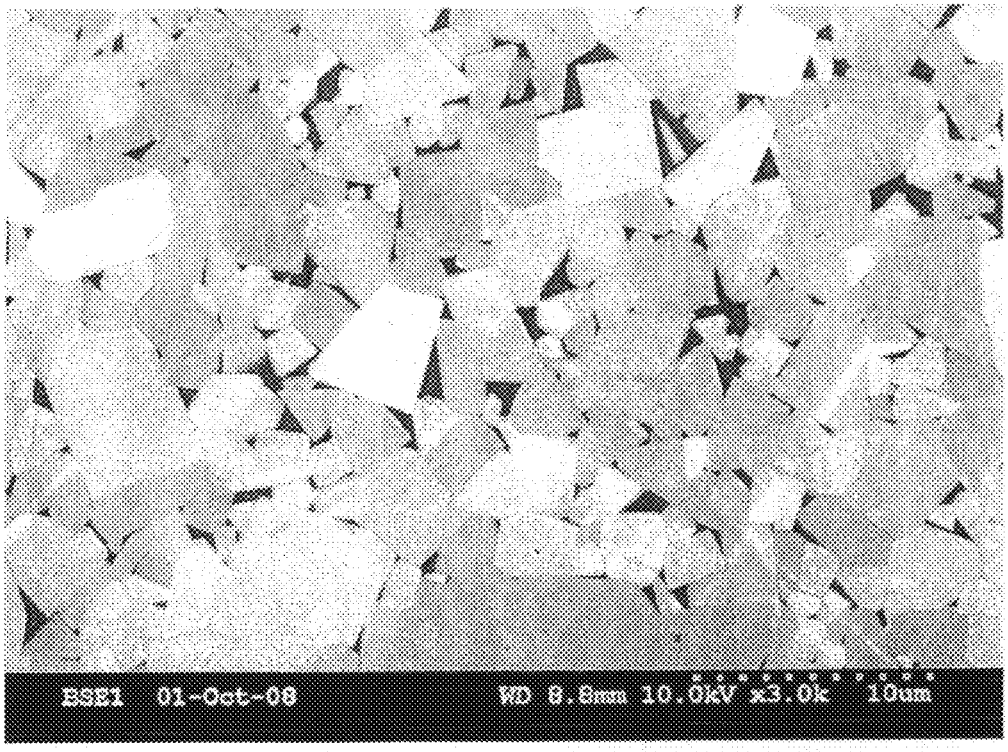
FIG. 7 shows representative SEM images of a sample at 0.3 mm depth.
Figure 8:
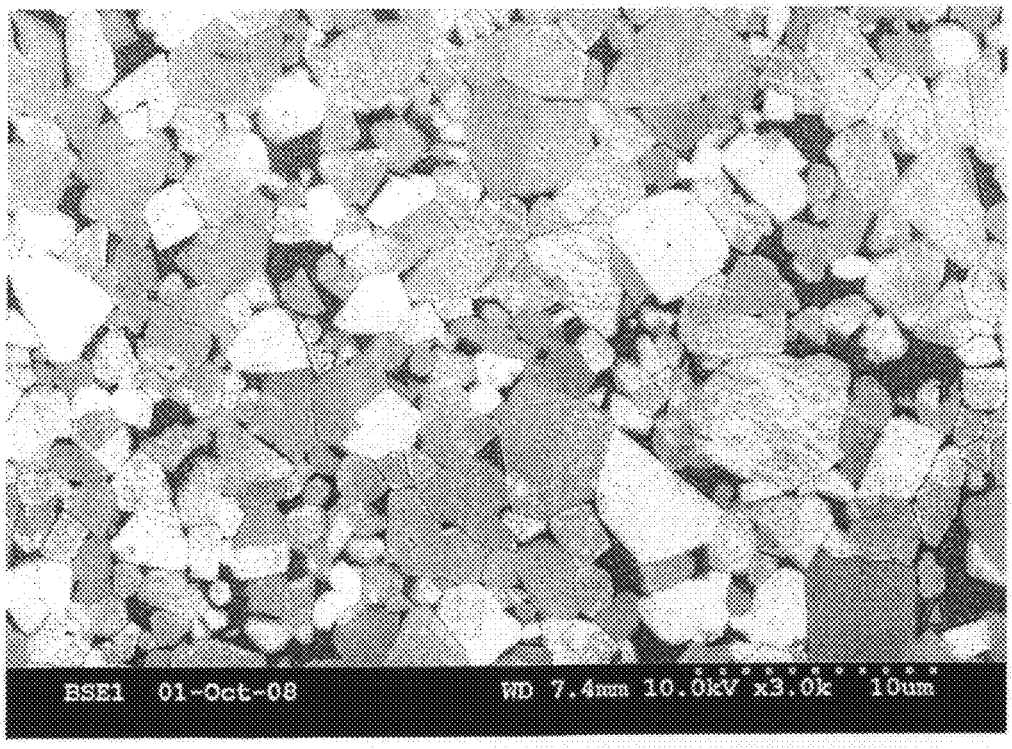
FIG. 8 is an image of unaffected bulk part (10 mm) of a sample.

FIG. 7 shows representative SEM images of Sample 6 at 0.3 mm depth. FIG. 8 is an image of unaffected bulk part (10 mm) of Sample 6.

EXAMPLE 3

Compacts of the same size and composition as in Example 1 were applied, "doped", with $Cr_3C_2$ as grain refiner compound and graphite or soot as grain growth promoter.

A combination of $Cr_3C_2$ and graphite or soot was applied by a combined dispersion comprising 20 wt % $Cr_3C_2$ and 10 wt % carbon as graphite or soot, in water. For all samples about 20 mg of slurry or dispersion was applied onto about 1.6 $cm^2$ of the tip.

The inserts were dried and then sintered at 1410° C. for 1 hour by conventional gas pressure sintering.

Vickers hardness was measured for the inserts on different depths, i.e., distances from the surface.

Figure 9:
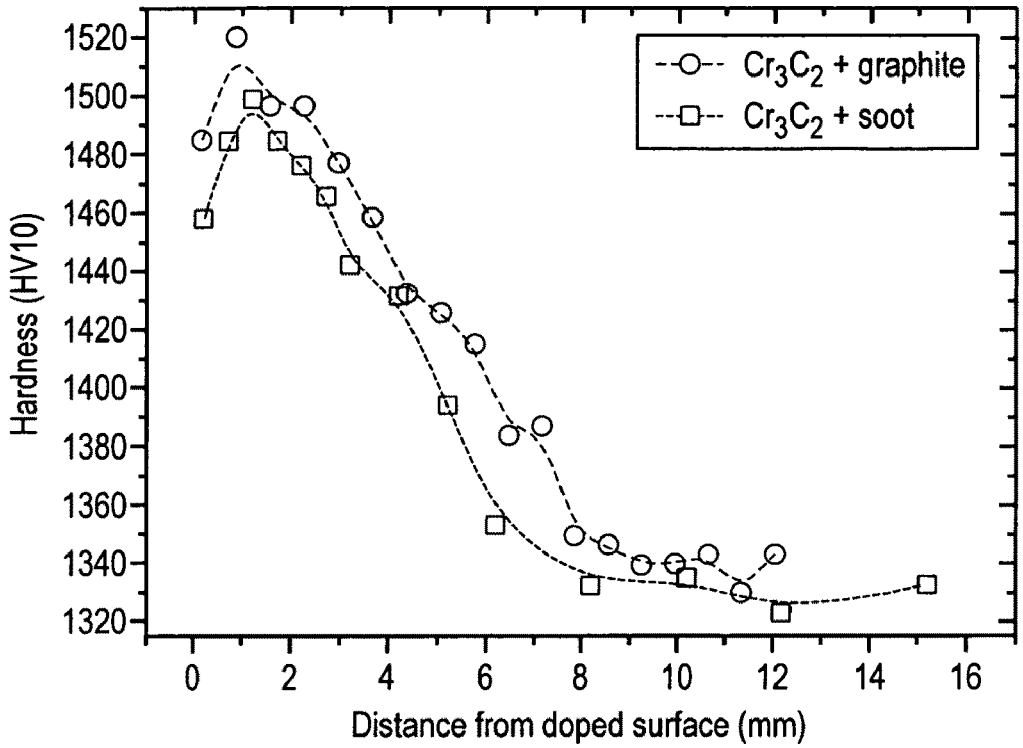
FIG. 9 shows the hardnesses (HV10) measured below the surface.

FIG. 9 shows the hardnesses (HV10) measured below the doped surface. It is evident that using soot with Cr3C2 generates as outstanding hardness gradients as when using graphite with Cr3C2.

There is an increase in hardness of about 160 units (HV) as compared with unaffected bulk material (8-10 mm depth) for the sample according to the invention. A maximum in hardness is found around 2 mm beneath the surface.

EXAMPLE 4

A cemented carbide powder blend was made by using standard raw materials having a composition of 93.5 wt-% WC and 6.5 wt % Co.

Compacts were made in the form of inserts for mining tools with 25 mm length having a cylindrical base of 16 mm diameter and a conical tip.

The average grain size was about 6 μm, measured as mean equivalent circle diameter.

The tips were applied, "doped", with a combination of $Cr_3C_2$ as grain refiner compound and graphite as grain growth promoter as a combined dispersion comprising 25 wt % $Cr_3C_2$ and 7.5 wt % graphite in water. For all samples about 40 mg of slurry or dispersion was applied onto about 3.2 $cm^2$ of the tip.

The inserts were dried and then sintered at 1520° C. for 1 hour by conventional gas pressure sintering.

Vickers hardness was measured for the inserts on different depths, i.e., distances from the surface.

Figure 10:
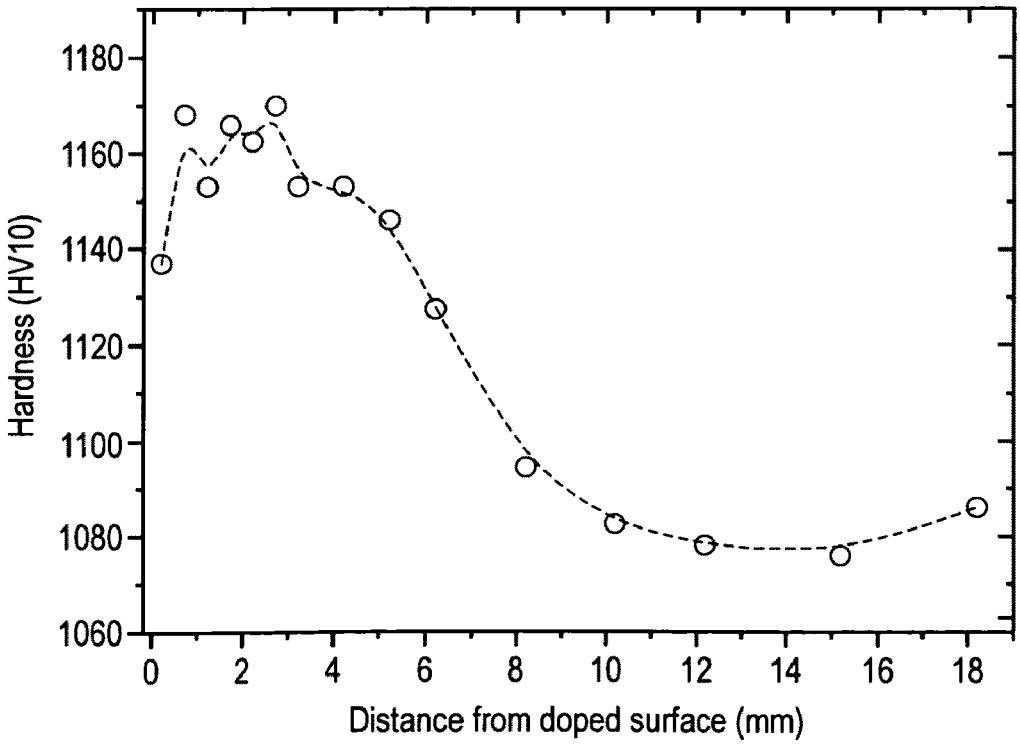
FIG. 10 shows the hardnesses (HV10) measured below the surface.

FIG. 10 shows the hardnesses (HV10) measured below the doped surface.

Table 6 shows the hardnesses (HV10) at different distances from the surface.

TABLE 6

| Distance beneath the surface (mm) | Hardness (HV10) |
|---|---|
| 0.2 | 1137 |
| 0.7 | 1168 |
| 1.2 | 1153 |
| 1.7 | 1166 |
| 2.7 | 1170 |
| 3.2 | 1153 |
| 4.2 | 1153 |
| 5.2 | 1146 |
| 6.2 | 1128 |
| 8.2 | 1094 |
| 10.2 | 1082 |

There is an increase in hardness of about 85 units (HV) as compared with unaffected bulk material (8-10 mm depth) for the sample according to the invention. A maximum in hardness is found around 2.5 mm beneath the surface for the samples according to the invention.

EXAMPLE 5

Figure 11:
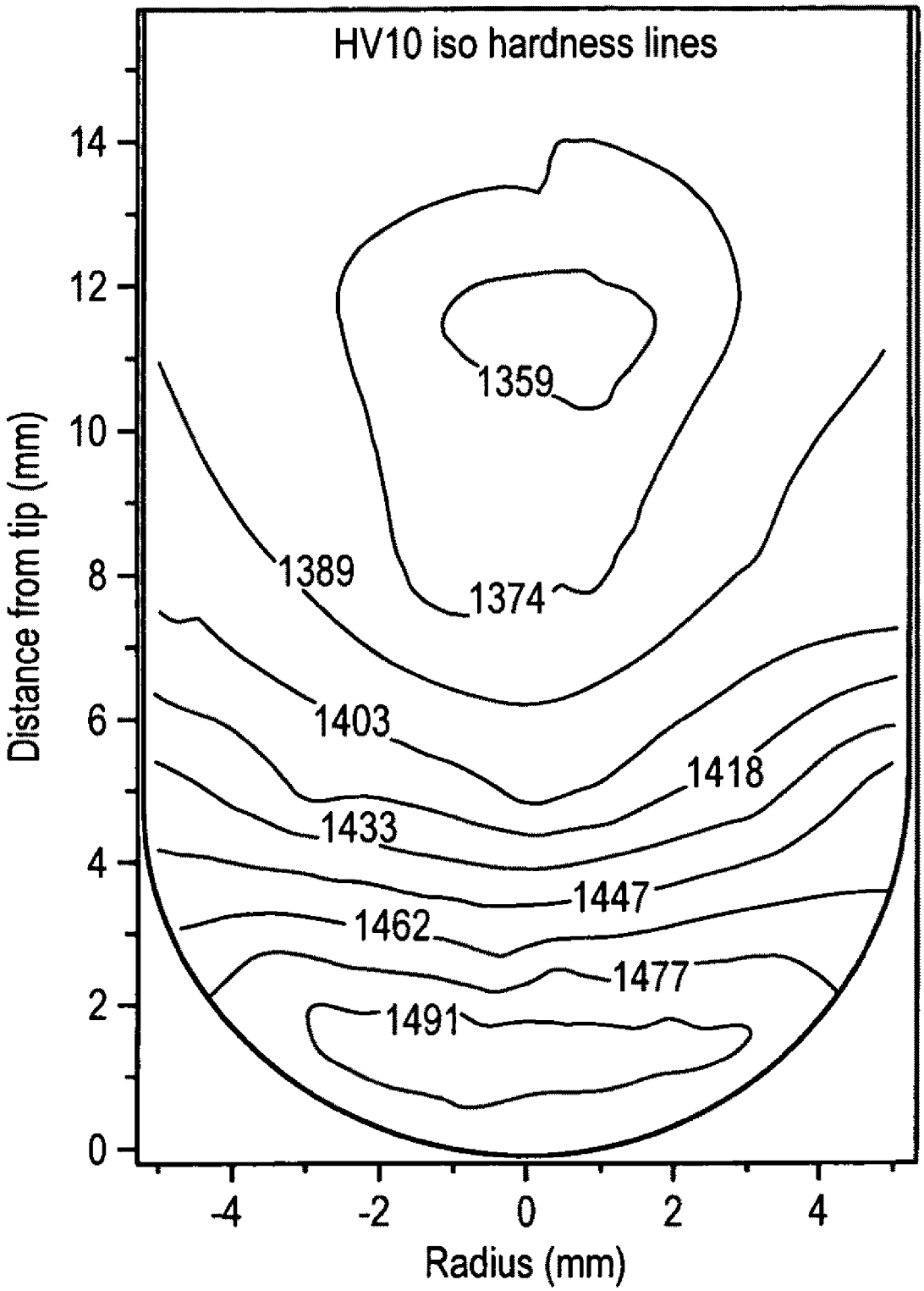
FIG. 11 shows calculated iso hardness (HV10) lines from measurements over a cross section below the surface.

Impact-resistant cemented carbide inserts according to the invention was compared with conventional homogenous cemented carbide inserts in a large field test in rock drilling of waste rock in Kiruna, Sweden. The conventional cemented carbide inserts had a composition of 94 wt % WC and 6 wt % Co. Also the gradient cemented carbide inserts of the invention comprised overall 94 wt % WC and 6 wt % Co but distributed in a gradient according to the invention. The cemented carbide inserts of the invention had been made following the procedure of Example 1. The gradient cemented carbide was tested in 20 drill bits with six gage inserts and three front inserts per bit. The drill bits have an initial gage diameter of 49.5 mm and were scraped at 45-46 mm. The gage and front inserts were 10 and 9 mm in diameter respectively. The gradient cemented carbide inserts were tested in the gage which is the most sensitive part of the bit. The front inserts were standard homogenous cemented carbide. This means 20×6=120 gradient inserts tested which should well cover the unavoidable spread in rock condition which is considered low in Kiruna waste rock. 20 identical bits with standard cemented carbide was used as reference. The inserts have a spherical dome tip and the geometry was identical for all 10 and 9 mm inserts respectively for both standard and the new gradient inserts. One insert was subjected for 70 HV10 measurements over a cross section and the iso hardness lines were calculated as shown by FIG. 11. It is clearly seen that the zone just beneath the doped surface is less hard, 1477 HV10 than 1-2 mm under the doped surface, HV 1491, where a hardness maximum is found.

The test was performed with a top hammer drill rig from Sandvik Tamrock. The hydraulic top hammer was a HFX5 with a working pressure of 210 bar and a feed pressure of 90 bar. The rotation was 230 rpm with a rotation pressure of 70 bar.

Table 7 below presents the average drill meters per bit, DM, average drilled meters per worn mm of the bit gage diameter, DM/mm and the average drilled meters to first failure, DMF. The bits were reground after about 58-59 drilled meters (about 12 holes/regrinding).

TABLE 7

| | DM | DM/mm | DMF | Hardness (HV10) |
|---|---|---|---|---|
| Homogenous conventional | 455 | 125 | 284 | 1430 |
| Cr3C2-graphite doped | 551 | 149 | 395 | 1370-1520 |

The results show an increase in wear resistance (DM and DM/mm) of 20% and a tool life increase (DMF) of 40% when comparing a drill bit with inserts according to the present invention and a drill bit with conventional inserts.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. Cemented carbide body comprising a WC-based hard phase and a binder phase, the body comprising an upper surface zone and an intermediate surface zone, wherein at least one part of the intermediate surface zone has a lower average binder content than a part further into the body, at least one part of the upper surface zone has in average a larger average WC grain size than the intermediate surface zone, and wherein at least one maximum of hardness occurs below the surface of the body.

2. Cemented carbide body according to claim 1, wherein:

the upper surface zone comprises the distance from a surface point down to a depth d1, the intermediate surface zone comprises the distance from d1 down to a depth d2; or to the most distant part from the surface point, whichever is reached first, and the ratio d1 to d2 is from about 0.01 to about 0.8.

3. Cemented carbide body according to claim 2, wherein the weight ratio binder concentration in a bulk zone present beneath the depth d2, to binder concentration at a depth of 1 mm from a surface point is from about 1.05 to about 5.

4. Cemented carbide body according to claim 2, wherein the weight ratio binder concentration at the most distant part from the surface point to binder concentration at a depth of 1 mm from the surface point is from about 1.05 to about 5.

5. Cemented carbide body according to claim 1, wherein the hardness maximum is situated at a depth from the surface of from about 0.1 to about 4 mm.

6. Cemented carbide body according to claim 1, which is a cutting tool insert for metal machining, an insert for a mining tool, or a coldforming tool.

7. Cemented carbide body according to claim 1, wherein the upper surface zone is from the surface of the body to a depth of about 0.1 to 4 mm and the intermediate surface zone is from the upper surface zone to a depth of about 15 mm.

* * * * *